US006525598B1

(12) United States Patent
Croman

(10) Patent No.: US 6,525,598 B1
(45) Date of Patent: Feb. 25, 2003

(54) BIAS START UP CIRCUIT AND METHOD

(75) Inventor: Russell Croman, Austin, TX (US)

(73) Assignee: Cirrus Logic, Incorporated, Austin, TX (US)

( * ) Notice: Subject to any disclaimer, the term of this patent is extended or adjusted under 35 U.S.C. 154(b) by 0 days.

(21) Appl. No.: 09/240,519

(22) Filed: Jan. 29, 1999

(51) Int. Cl.[7] ..... G05F 3/24; G05F 3/26

(52) U.S. Cl. ..... 327/543; 327/541; 327/198; 323/315

(58) Field of Search ..... 327/538, 540, 327/541, 542, 543, 544, 545, 546, 142, 198; 323/313, 315, 901

(56) References Cited

U.S. PATENT DOCUMENTS

| | | | | | |
|---|---|---|---|---|---|
| 4,833,344 | A | | 5/1989 | Moon et al. | 327/540 |
| 4,857,823 | A | | 8/1989 | Bitting | 323/314 |
| 4,897,616 | A | | 1/1990 | Wang et al. | 330/265 |
| 5,155,384 | A | | 10/1992 | Ruetz | 327/537 |
| 5,367,249 | A | * | 11/1994 | Honnigford | 323/313 |
| 5,519,347 | A | | 5/1996 | Kim | 327/143 |
| 5,670,907 | A | * | 9/1997 | Gorecki et al. | 327/535 |
| 5,680,038 | A | | 10/1997 | Fiedler | 323/315 |
| 5,686,824 | A | * | 11/1997 | Rapp | 323/315 |
| 5,748,040 | A | | 5/1998 | Leung | 330/253 |
| 5,751,182 | A | | 5/1998 | Thiel, IV | 327/539 |
| 5,834,983 | A | | 11/1998 | Higgins, Jr. | 331/109 |
| 5,838,191 | A | | 11/1998 | Opris et al. | 327/530 |
| 5,844,434 | A | | 12/1998 | Eschauzier | 327/143 |
| 5,856,749 | A | | 1/1999 | Wu | 327/66 |
| 5,912,580 | A | * | 6/1999 | Kimura | 327/540 |

* cited by examiner

*Primary Examiner*—Timothy P. Callahan
*Assistant Examiner*—Terry L. Englund
(74) *Attorney, Agent, or Firm*—Dan Shifrin; Richard D. Egan

(57) ABSTRACT

A high swing cascode bias circuit is provided for use within an integrated circuit. The bias circuit utilizes a start up transistor. The use of the start up transistor allows for high swing at the bias circuit outputs even though only one current source is provided from a reference bias circuit. The bias circuit may be powered down in response to a power down control signal. When the bias circuit is activated a plurality of bias signals may be provided to operating circuits of the integrated circuit.

24 Claims, 4 Drawing Sheets

BIAS START UP CIRCUIT AND METHOD

BACKGROUND OF THE INVENTION

1. Field of the Invention

The present invention relates generally to bias circuits. More specifically, the present invention relates to bias start-up circuits.

2. Description of the Related Art

Bias circuits are utilized to provide bias voltages or bias currents in a wide variety of integrated circuits. Within an integrated circuit, the bias voltages or currents are utilized in many different circuits to provide proper bias levels for the various transistor circuitry. Generally, a highly accurate and non-temperature dependent circuit such as a band-gap voltage source is utilized to generate a reference bias voltage or current. The reference bias voltage or current may then be provided to additional or secondary bias circuitry to generate a plurality of bias voltages or currents.

The secondary bias circuitry may be utilized to drive operating circuitry that may be high swing or low swing circuitry. In general to drive high swing operating circuitry, the amount of the total power supply voltage consumed by the biasing devices should be relatively low and a relatively large amount of voltage remains so that wider signal voltage variations (i.e. swing) may be obtained from the operating circuitry. Generally, higher swing in the operating circuitry is desirable because it typically results in a higher signal to noise ratio of the operating circuit. A bias circuit for use with high swing operating circuits generally provides outputs relatively close to the voltage rails (as compared to a bias circuit which may only bias a low swing circuit). A bias circuit for biasing a high swing operating circuit may be identified as a high swing bias circuit (which may also be utilized for biasing a low swing operating circuit) and a bias circuit for biasing a low swing operating circuit may be identified as a low swing bias.

For example, FIG. 1C is a prior art bias circuit configured in a cascode manner which may provide outputs (pm, pc, nm, and nc) that may be utilized to bias a high swing circuit. FIG. 1A, however, is a prior art bias circuit configured in a cascode manner which may provide outputs (pm, pc, nm, and nc) that will only bias a low swing circuit. With reference to FIG. 1C, in a circuit with a 2.5 Vdd level and typical transistor Vt and Von values, a high swing bias circuit may provide voltage outputs ranging of 0.75 V, 1.0 V, 1.5 V and 1.75 V at output nodes nm, nc, pc, and pm respectively.

In order to conserve power, it is generally desirable to power down the secondary bias circuitry at times in which the integrated circuit or portions of the integrated circuit are not operating or do not require the bias voltages or currents. After power down, a method to restart or power up the secondary bias circuitry quickly and efficiently is desirable.

FIGS. 1A, 1B and 1C illustrate exemplary prior art bias circuits. For example, FIG. 1A illustrates a low swing cascode bias circuit 10. A current source 100 is provided from a reference bias circuit, such as for example bias circuit based upon a band-gap voltage source circuit. An n-channel cascode transistor 102 and an n-channel mirror transistor 104 are also provided. Four voltage outputs pm, pc, nc, and nm are coupled to transistors 106, 108, 110 and 112 respectively. As used herein the outputs are labeled p for p-channel, n for n-channel, c for cascode and m for mirror.

FIG. 1B illustrates a high swing cascode bias circuit 12 for generating four bias voltages pm, pc, nc, and nm. The non-series connections of transistors 102 and 104 and transistors 106 and 108 provide a higher swing for the bias circuit 12 outputs pm, pc, nc, and nm. Because of the non-series connection of p-channel transistors 106 and 108, additional n-channel transistors 114 and 116 are provided as shown. The bias circuit 12, requires an additional current source 101 to be generated from the reference bias circuit as compared to the circuit of FIG. 1A. This additional current source 101 increases the circuitry within the reference bias circuit and increases the number of routing leads that are required between the reference bias circuit and the bias circuit 12.

FIG. 1C illustrates yet another bias circuit 14. The bias circuit 14 also requires two bias currents to be provided from the reference bias circuit. Thus the bias circuit 14 suffers from some of the same problems as the bias circuit 12 of FIG. 1B. The circuits of FIGS. 1A–1C may be powered down through the use of power down switches 120 which may be closed during power down modes to tie nodes pm and pc to Vdd and nodes nc and nm to ground.

It would be desirable to provide a bias circuit which solves the problems discussed above and others.

SUMMARY OF THE INVENTION

In accordance with the present invention, a high swing cascode bias circuit is provided for use within an integrated circuit. The bias circuit utilizes a start up transistor. The use of the start up transistor allows for high swing at the bias circuit outputs even though only one current source is provided from a reference bias circuit. The bias circuit may be powered down in response to a power down control signal. When the bias circuit is activated a plurality of bias signals may be provided to operating circuits of the integrated circuit.

DESCRIPTION OF THE PREFERRED EMBODIMENTS

Figure 2A:
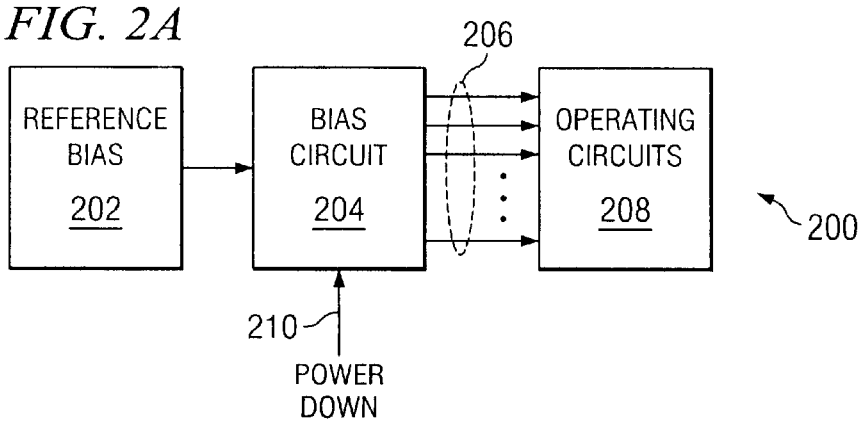
FIG. 2A is a block diagram of an integrated circuit which may utilize the present invention.

The present invention may be utilized in an integrated circuit, such as for example, integrated circuit 200 of FIG. 2A. As shown in FIG. 2A, the integrated circuit may include a reference bias circuit 202, a bias circuit 204 and operating circuits 208. The reference bias circuit 202 may provide either a voltage or current to a bias circuit 204, thus acting as a dc voltage or current source for the bias circuit 204. The reference bias circuit 202 may be, for example, a band-gap voltage circuit used to generate either a voltage or current. Alternatively a precision resistive trimmed circuit may be used to generate a precise voltage or current source. Other methods may also be utilized as is known in the art to generate a precise dc source. Bias circuit 204 generates one or more bias signals 206. The bias circuit 204 may also receive a power down signal 210. The power down signal 210 may activate or de-activate the bias circuit 204. In this manner power usage of the bias circuit 204 may be decreased when the bias signals are not needed, such as for example when operating circuits 208 are powered down. The bias signals 206 may be either current or voltage signals. The operating circuits 208 receives the bias signals 206 for use as bias inputs.

The block diagram of FIG. 2A may be implemented within an integrated circuit in a number of manners. In one example, the output of the reference bias circuit 202 may be a current generated at one portion of the integrated circuit. A plurality of operating circuits 208 may be distributed across the integrated circuit 200 with one bias circuit 204 associated with each operating circuit. The bias circuit 204 may be associated locally with each operating circuitry and may provide a bias current to the operating circuitry. Thus, relatively long electrical routing leads may be utilized to provide the reference bias current to each bias circuit (a plurality of such bias circuits distributed across the die) with relatively short electrical routing leads utilized to provide the bias signals 206 to each operating circuit. The operating circuits 208 may be any electrical circuits which perform the electrical functions that the integrated circuit is designed to perform.

The bias signals 206 may be utilized within the operating circuits 208 as bias voltages or currents as provided on the bias signals 206. For example, if the bias signals 206 are bias voltages, the operating circuits 208 may utilize bias voltages as the bias sources. Alternatively, the voltages provided as bias signals 206 may be converted to bias currents within the operating circuits 208. Likewise if bias signals 206 are bias currents, the currents may be utilized directly or converted to voltages within the operating circuits 208. Thus, though shown conceptually as segregated circuit blocks, portions of the functionality of the various circuit blocks may be intermingled with other blocks.

Figure 1A:
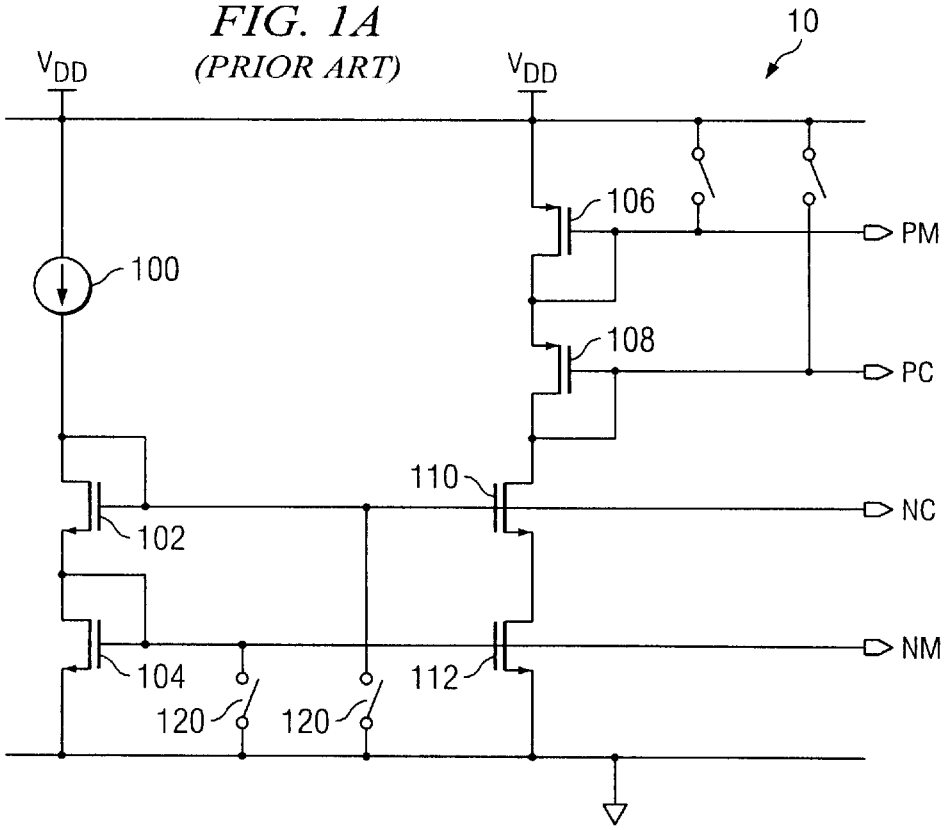
FIG. 1A (PRIOR ART)
FIGS. 1A, 1B, and 1C illustrate prior art bias circuits.
Figure 1B:
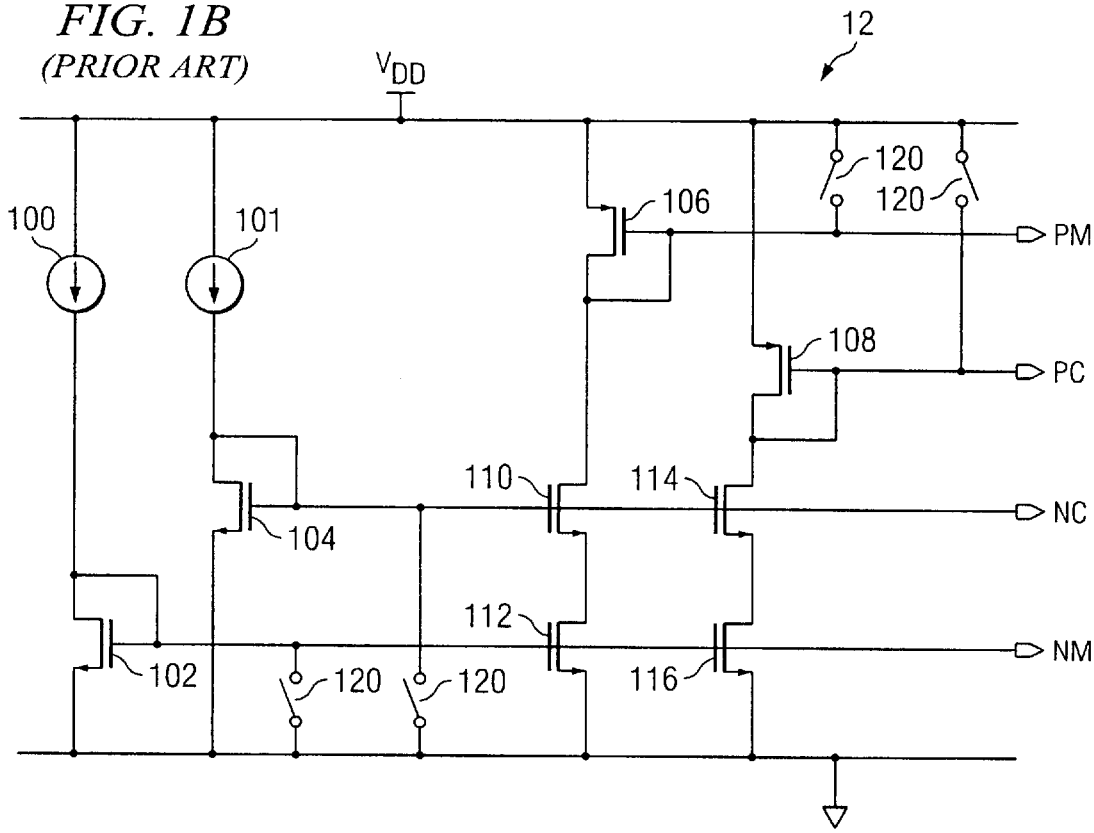
FIG. 1B (PRIOR ART)
Figure 1C:
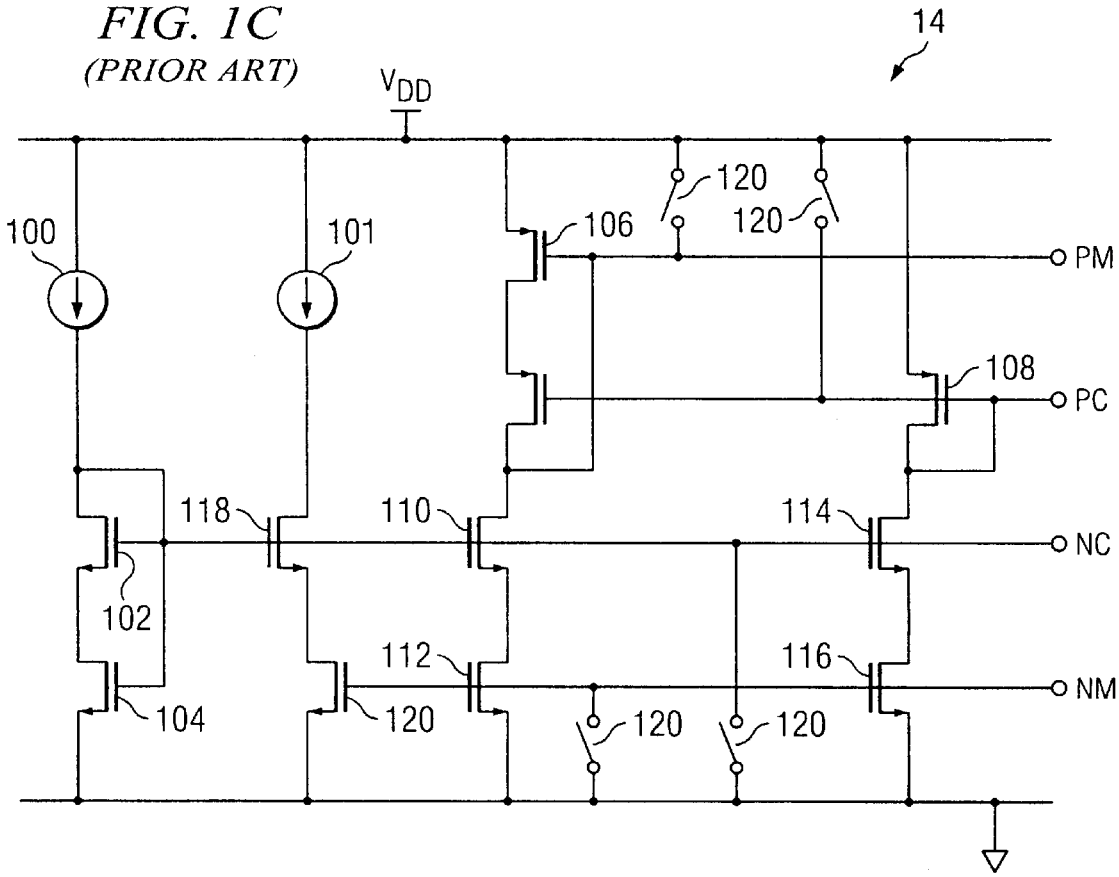
FIG. 1C (PRIOR ART)
Figure 2B:
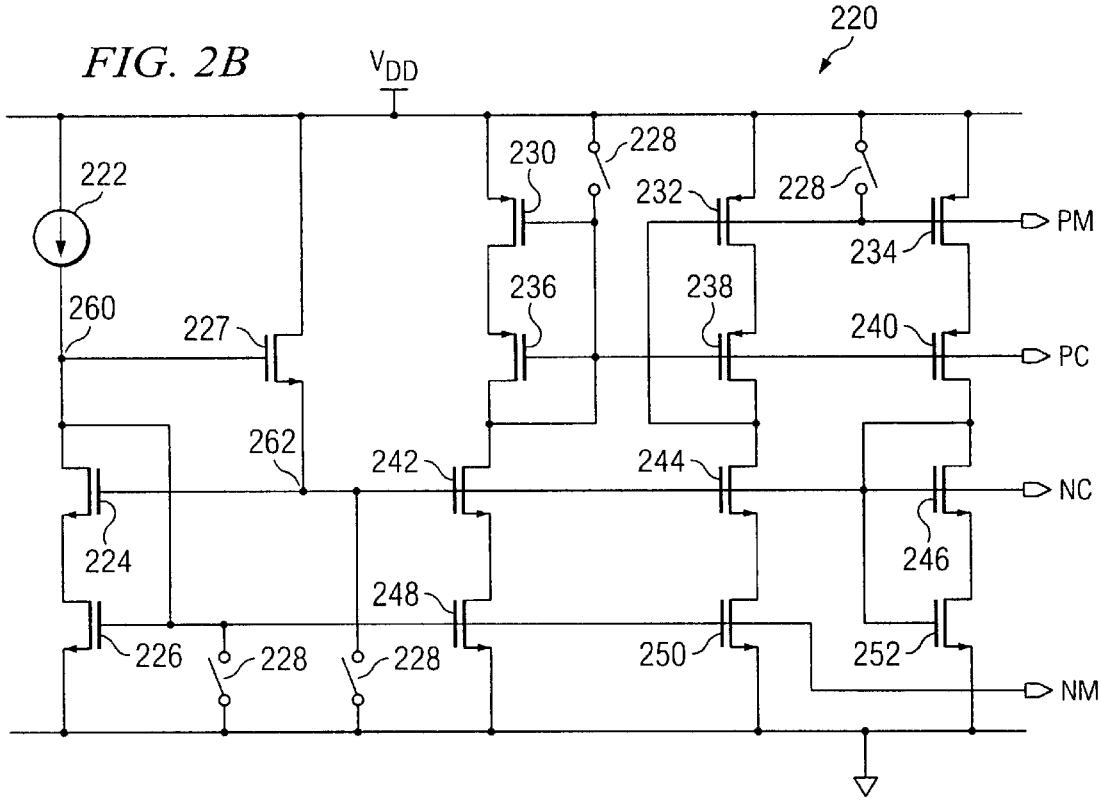
FIG. 2B is a circuit diagram of one embodiment of a bias circuit according to the present invention.

A circuit for use as the bias circuit 204 is shown in FIG. 2B. The bias circuit 220 of FIG. 2B receives a dc or constant current from a current source 222. The current source 222 may be generated from a reference bias circuit, such as for example, a band-gap voltage source circuit. The bias circuit 220 operates as a high swing cascode bias circuit, yet only requires a single current source (current source 222). In this manner, the routing of additional leads from the reference bias circuit (as compared with a plurality of current sources such as in prior art FIG. 1B) is minimized. Moreover, the complexity of the reference bias may also be reduced.

The current source 222 is connected to the drain of an n-channel transistor 224. The source of transistor 224 is connected to the drain of an n-channel transistor 226 as shown in the figure. The source of the transistor 226 is connected to ground. The gate of transistor 226 is also connected to the current source 222. The current source 222 is also connected to the gate of a start-up transistor 227. The source and drain of the start up transistor 227 are connected to the gate of transistor 224 and Vdd respectively as shown. The bias circuit 220 also includes four power down switches 228 which have one side coupled to at least one of the power supplies (Vdd or GROUND). When the bias circuit 220 is desired to be operating to provide the desired bias outputs pm, pc, nc, and nm, the power down switches 228 are opened. In a power down mode, the switches 228 may be closed, and thus, the power usage minimized as all transistors will be turned off. In the power down mode the bias outputs pm and pc will be pulled to one power supply (Vdd) while the bias outputs nc and nm will be pulled to the other power supply (GROUND). In this manner the power down switches activate or de-activate the bias circuit 220.

The bias circuit 220 also includes three output legs (or stages) having a plurality of transitors with source/drains coupled in series. The first output leg (or stage) includes p-channel mirror transistor 230, p-channel cascode transistor 236, n-channel cascode transistor 242, and n-channel mirror transistor 248. The second output leg (or stage) includes p-channel mirror transistor 232, p-channel cascode transistor 238, n-channel cascode transistor 244, and n-channel mirror transistor 250. The third output leg (or stage) includes a p-channel mirror transistor 234, p-channel cascode transistor 240, n-channel cascode transistor 246, and n-channel mirror transistor 252.

The operation of the bias circuit 220 will be explained below starting from an initial power down condition (i.e. switches 228 all closed). In the power down mode, transistors 224, 226, and 227 will be off. Thus, the current from current source 222 (a reference bias current) will be shunted to ground through one of the power down switches 228. In power down the nm and nc outputs will be at ground and the pm and pc outputs will be at Vdd voltage levels. When a control signal is provided to the power down switches 228 to open the switches 228, the voltage on node 260 (connected to the gates of the start up transistor 227 and transistor 226, and the output nm) will begin to rise. Initially, no current will flow through transistors 224 and 226 because transistor 224 is off. However, as the voltage on node 260 continues to rise, transistors 226 and 227 begin to turn on. Because the gates of n-channel mirror transistors 248 and 250 are also coupled to the gate of transistor 226, transistors 248 and 250 will also begin to turn on. The activation of transistor 227 will in turn increase the voltage on node 262 which is connected to the gate of transistor 224 (also the output node nc). When the transistor 224 turns on, current will flow through transistors 224 and 226. In this manner, start up transistor 227 helps start up the bias circuit 220 from the power down mode since this transistor turns on and passes a sufficient voltage to the gate of transistor 224 to turn on transistor 224 and activate the bias circuit. Because the gates of n-channel cascode transistors 242, 244, and 246 are also coupled to the gate of transistor 224, transistors 242, 244 and 246 will also begin to turn on. Turning on transistors 242, 244, 246, 248, 250 and 252 will pull down gates of and turn on the p-channel cascode and mirror transistors 236, 238, 240, 230, 232, and 234 respectively. Thus, the outputs nm and nc are pulled from the ground rail voltage while the outputs pm and pc are pulled from the Vdd rail voltage.

The use of the start up transistor 227 thus permits a bias circuit to be operated with only, one current source from the reference bias circuit. Moreover, the output nodes of the bias circuit may be at voltage levels closer to the levels of the voltage rails (pm and pc closer to Vdd and nm and nc closer to ground) because the gate of one transistor (226) may be connected directly to the current source while the gate of the second transistor (224) may be connected directly to the source of the start up transistor. In this manner, the gate voltage on transistor 224 (and also the gates of transistors 248 and 250 and the nm output) may be pulled closer to the high voltage rail without being limited by a transistor gate to source voltage drop. Without the use of start up transitor 227, the circuit of FIG. 2B may suffer from problems. More particular at start up after the power down switches are switched, current might not flow through transistors 246 and 252, thus preventing current flow in transistors 224 and 226.

Figure 3:
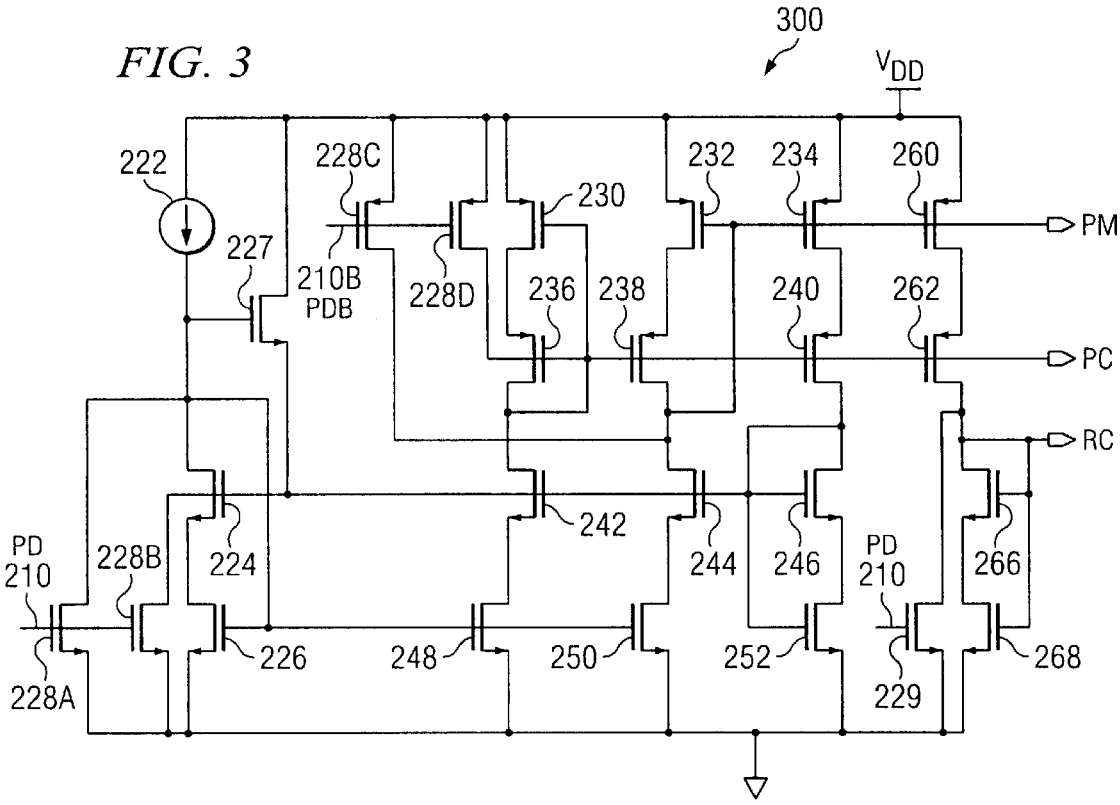
FIG. 3 is a circuit diagram of another embodiment of a bias circuit according to the present invention.

The configuration of the output legs or stages of the bias circuit 220 is merely exemplary and other configurations may be utilized. Furthermore, more or less outputs may be generated than the four outputs (pm, pc, nc, and nm) as shown in FIG. 2B. FIG. 3 illustrates, for example, a bias circuit 300 in which three outputs (pm, pc, and rc) are provided. The circuit of FIG. 3 is similar to the circuit of FIG. 2B and like reference numerals are used for common elements. The power down switches 228 of FIG. 2B are indicated as power down transistors 228A, 228B, 228C, and 228D. The control signals PD and PDB control the power down transistors with PD being high during the power down mode and PDB being the inverse of PD (i.e. low during the power down mode). As can be seen from the figures, the circuit of FIG. 3 differs from that of FIG. 2 through the addition of a fourth output leg or stage formed by transistors 260, 262, 266 and 268. The gate of transistor 260 is coupled to the pm output, the gate of transistor 262 is coupled to the pc output, and the gates of transistors 266 and 268 are coupled to the rc output. An additional power down switch 229 is controlled by the PD control signal and coupled to the fourth output leg or stage. The bias circuit 300 is placed in a power down mode and started up through the use of the power down switches, transistors 224 and 226, current source 222 and the start up transistor 227 as described above with reference to bias circuit 220 of FIG. 2B.

As noted above, the bias circuit 300 of FIG. 3 is configured to provide three bias outputs. However, additional outputs may be provided. For example, nc and nm outputs may be provided from the gates of transistors 246 and 250 respectively, similar to as shown in FIG. 2B.

As mentioned above, the present invention may be utilized with a wide variety of configurations of the bias circuit to provide a various number of outputs and various signal levels of the outputs. For example in the configuration of FIG. 3 three voltage outputs may be provided from the bias circuit and converted to current outputs with the circuit of FIG. 4. At least a portion of the circuitry of FIG. 4 may be considered to be a portion of the bias circuitry. The example of FIG. 4 illustrates the use of four voltage nodes pm, pc, nc, and nm, such as generated from the circuit of FIG. 2B.

Figure 4:
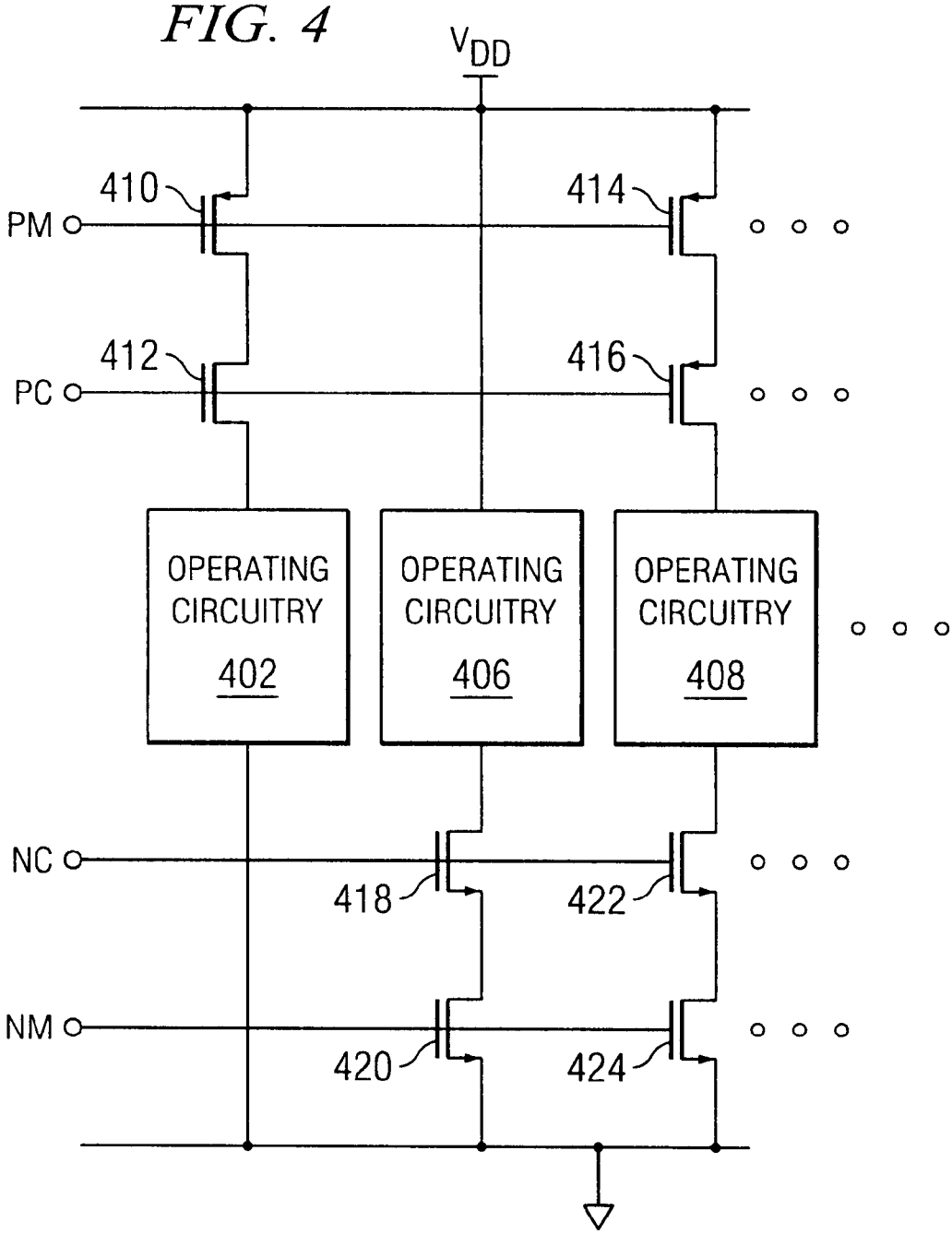
FIG. 4 is a circuit diagram of a voltage to current conversion circuit utilized with the present invention.

As shown in FIG. 4, these nodes may be applied to one or more sections of operating circuitry, such as sections 402, 406, and 408. In each case, at least some of the voltages on nodes pm, pc, nc, and nm are utilized to generate currents supplied to the operating circuits. Thus, bias currents are generated for the operating circuitry 402 through the use of the pm and pc outputs and transistors 410 and 412. Similarly, bias currents are generated for the operating circuitry 406 through the use of the nm and nc outputs and transistors 418 and 420. Operating circuitry 408 illustrates an example in which bias currents are provided utilizing all four voltages pm, pc, nc, and nm through the use of transistors 414, 416, 422, and 424. The configurations shown in FIG. 4 are exemplary embodiments and other configurations, including additional operating circuits, may be utilized. In one embodiment the mirror transistors 410, 414, 420, and 424 may be sized to be integer multiples of the sizes of the corresponding mirror transistors in the bias circuitry (for example the mirror transistors of FIG. 2B).

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as presently preferred embodiments. Equivalent elements may be substituted for those illustrated and described herein, and certain features of the invention may be utilized independently of the use of other features, all as would be apparent to one skilled in the art after having the benefit of this description of the invention.

What is claimed is:

1. A high swing cascode bias circuit, the bias circuit comprising:

a first transistor;

a second transistor, a source or drain of the first transistor coupled to a source or drain of the second transistor;

a dc supply coupled to a gate of the second transistor; and a third transistor, a gate of the third transistor coupled to the dc supply, the third transistor operating as a start up transistor by turning on the first transistor when the third transistor is turned on.

2. The circuit of claim 1, the dc supply being a current source.

3. The circuit of claim 2, further comprising at least one power down switch, the at least one power down switch coupling at least the gate of the first transistor or the gate of the second transistor to a predetermined voltage level during a power down mode of the circuit.

4. The circuit of claim 2, the source and drain of the third transistor being coupled between a supply voltage and the gate of the first transistor.

5. The circuit of claim 4, the gates of the first transistor and the second transistor being coupled to at least one output stage, the at least one output stage being coupled to a plurality of outputs of the bias circuit.

6. A method of operating a high swing bias circuit, comprising:

providing one reference current to the bias circuit;

providing a power control signal to activate or de-activate the bias circuit;

utilizing the one reference current to generate a voltage on a gate of a second transistor upon the activation of the bias circuit;

utilizing the one reference current to generate the voltage on a gate of a third transistor upon the activation of the bias circuit; and generating another voltage on a gate of a first transistor in response to a switching state of the third transistor, the third transistor operating as a start up switch such that a high swing bias output is provided by utilizing the one reference current.

7. The method of claim 6, the power control signal being provided to at least one power down switch, the gate of the first transistor or the gate of the second transistor being held at a predetermined level when the bias circuit is powered down.

8. The method of claim 7, the power control signal being provided to a plurality of power down switches, the power down switches holding at least the gate of the first transistor and the gate of the second transistor at the predetermined level when the bias circuit is powered down.

9. The method of claim 6, the source and drain of the third transistor being coupled between a supply voltage and the gate of the first transistor.

10. The method of claim 6, further comprising changing the electrical states on a plurality of outputs of the bias circuit in response to the voltages generated on the gates of the first and second transistors.

11. A bias circuit comprising a current source;

at least one start up transistor, the gate of the at least one start up transistor coupled to the current source;

a first voltage node coupled to the current source;

at least one first power down switch, the at least one first power down switch having a power down state and a power up state;

a second voltage node coupled to the at least one start up transistor, one of the first or second voltage node being responsive to the first power down switch such that a voltage level of the respective first or second voltage node changes when the state of the first power down switch changes; and at least one bias circuit output, an electrical value of the at least one bias circuit output changing when the voltage levels of the first and second voltage nodes change.

12. The circuit of claim 11, further comprising at least a second power down switch, the other of the first or second voltage node being responsive to the second power down switch such that a voltage level of the respective first or second voltage node changes when the state of the second power down switch changes.

13. The circuit of claim 12, the source and drain of the at least one start up transistor being coupled between a voltage supply and at least one of the first or second power down switches.

14. The circuit of claim 11, further comprising:

a gate of a first transistor being coupled to the second voltage node and a source or drain of the first transistor being coupled to the first voltage node; and a gate of a second transistor being coupled to the first voltage node and a source or drain of the second transistor being coupled to a source or drain of the first transistor.

15. The circuit of claim 14, a source and drain of the at least one start up transistor being coupled between a voltage supply and the gate of the first transistor.

16. A method of providing a plurality of bias outputs from a bias circuit, comprising:

holding a first voltage node and second voltage node at a first voltage level during a power down state;

releasing the first voltage node and second voltage node from the first voltage level during a power up state;

pulling the first voltage node to a second voltage level upon the releasing of the first voltage node through the use of a reference current source coupled to the first voltage node;

pulling the second voltage node to a third voltage level upon the releasing of the second voltage node by using a start up switch, the start up switch coupled to the reference current source; and changing the electrical states of the plurality of bias outputs in response to the voltage levels of the first voltage node and the second voltage node changing.

17. The method of claim 16, the start up switch being a transistor being coupled to the first and second voltage nodes.

18. The method of claim 16, further comprising coupling the first voltage node to a gate of a second transistor and coupling the second voltage node to a gate of a first transistor, a source or drain of the first transistor coupled to the first voltage node.

19. The method of claim 18, the start up switch being a third transistor, the third transistor being coupled to the first and second voltage nodes.

20. The method of claim 19, further comprising the first and second transistors turning on in response to the circuit being placed in the power up state.

21. A high swing cascode bias circuit, comprising:

a single current source;

a start up switch coupled to the current source;

at least one output circuit responsive to the start up switch for providing a high swing bias output, wherein the start up switch is a first transistor, a gate of the first transistor coupled to the current source;

a power control signal to activate or de-activate the bias circuit;

a second transistor, a voltage being coupled to a gate of the second transistor and a gate of the first transistor in response to the current source upon the activation of the bias circuit; and a third transistor, a voltage being coupled to a gate of the third transistor in response to turning on the first transistor.

22. The circuit of claim 21, further comprising at least one power down switch coupled to the high swing bias output.

23. The circuit of claim 21, wherein the current source is utilized to turn on the start up switch upon activation of the bias circuit.

24. The circuit of claim 21, further comprising at least one power down switch, the at least one power down switch utilized to activate at least part of the bias circuit.

* * * * *